US005095829A

United States Patent [19]

Nevels

[11] Patent Number: 5,095,829

[45] Date of Patent: Mar. 17, 1992

[54] METHOD FOR COMBUSTING MULTIFARIOUS WASTE MATERIAL, AND AN OVEN TO BE USED THEREBY

[76] Inventor: Leonardus M. M. Nevels, Daalzicht 37, 6097 EK Heel, Netherlands

[21] Appl. No.: 617,072

[22] Filed: Nov. 23, 1990

[51] Int. Cl.[5] ..... F23G 5/12

[52] U.S. Cl. ..... 110/346; 110/211; 110/214; 110/229; 110/235; 110/215

[58] Field of Search ..... 110/229, 211, 214, 346, 110/344, 345, 235, 215

[56] References Cited

U.S. PATENT DOCUMENTS

| | | | |
|---|---|---|---|
| 2,125,517 | 8/1938 | Nicol | 110/18 |
| 3,836,987 | 9/1974 | Gibbons et al. | 354/300 |
| 4,429,645 | 2/1984 | Burton | 110/346 |
| 4,794,871 | 1/1989 | Schmidt et al. | 110/341 |
| 4,821,653 | 4/1989 | Jones | 110/229 |
| 4,922,841 | 5/1990 | Kent | 110/214 X |
| 4,971,599 | 11/1990 | Cordell et al. | 110/229 X |

FOREIGN PATENT DOCUMENTS

| | | |
|---|---|---|
| 0173628 | 3/1986 | European Pat. Off. . |
| 0243889 | 11/1987 | European Pat. Off. . |
| 1116336 | 11/1961 | Fed. Rep. of Germany . |
| 3245587 | 6/1984 | Fed. Rep. of Germany . |
| G8505936.6 | 11/1986 | Fed. Rep. of Germany . |
| 2197149 | 3/1974 | France . |
| 2213706 | 8/1974 | France . |
| 8902490 | 5/1991 | Netherlands . |
| 1437224 | 5/1976 | United Kingdom . |
| WO90/05269 | 5/1990 | World Int. Prop. O. . |

OTHER PUBLICATIONS

Patent Abstracts of Japan, vol. 14, No. 364 (M-1007) [4307], published Aug. 7, 1990, and Japanese 2-130308.

Volkmann, "Thermal Recycling Technology: A New Dimension in Waste Control", Energy and Automation, vol. 11, No. 5, Sep./Oct. 1989, pp. 4-7.

*Primary Examiner*—Edward G. Favors

*Attorney, Agent, or Firm*—Foley & Lardner

[57] ABSTRACT

A method is provided for combusting multifarious waste material. The waste to be combusted is subjected to a self maintaining pyrolysis in a long, horizontal chamber oven under oxygen depleted conditions, and is subsequently completely combusted under a supply of adequate air. A chamber oven is provided with an upper row of closable air inlet apertures at the upper side, divided over the wall length, and a lower row of closable air inlet apertures at the lower side, divided over the wall length. A larger air inlet aperture is provided in each one of the side walls in the vicinity of the oven throat, and air inlet apertures are also provided in the off-gas conduit.

19 Claims, 3 Drawing Sheets

METHOD FOR COMBUSTING MULTIFARIOUS WASTE MATERIAL, AND AN OVEN TO BE USED THEREBY

BACKGROUND OF THE INVENTION

The invention relates to an method for combusting multifarious waste material, as well as a oven to be used thereby. The invention also relates to a universal combustion system with a number of such ovens.

Waste removal is one of the most serious problems of the present time. In order to be able to stand up to the continuously increasing quantities of waste materials, waste is more and more often disposed of by means of combustion. In practice, solid and liquid waste materials are mainly combusted in ovens with a sliding grid or ovens with a rotating drum. In ovens with a sliding grid, waste materials are continuously supplied to a moving grid and air is blown through the burning mass by way of apertures in the grid. The temperature may increase locally to over 1000° C., while elsewhere the temperature may remain below 800° C. Under such conditions much fly-ash is formed, while in the areas where the temperature is too low, unpleasantly smelling substances will remain or be formed by incomplete combustion, which by their unpleasant smell alone will already create a burden for the environment.

In a oven with an rotating drum, waste materials are kept in motion by the slow rotation of the cylindrically shaped oven, under which conditions the advantage is obtained, that the areas of too low a temperature, such as in a oven with a grid, may be avoided. However the temperature for a oven with a rotating drum should not rise much above 1000° C. in order to prevent the deposition fluid slag against the wall. Downstream of an oven with a rotating drum, a chamber for after-burning may be positioned, in which the temperature is increased to, for example, 1150° C. by additional combustion of fuel.

The residence times of gases in hot areas (temperatures of more than 800° C.) of the ovens amount in general to 1 to 3 sec. The incomplete combustion, the relatively low temperature, the short residence times of the compounds in the hot areas, provide the conditions for the formation of many poisonous and unpleasant smelling compounds, such as dioxins and benzofuranes.

As such oven processes are very expensive, it is in general the objective, that the thermal energy created thereby will not get lost, but will be utilized as much as possible for re-use. To that end the hot combustion gases created, are passed into a steam-boiler in order to utilize the energy of the gases for generating steam. Thereby the gases will gradually cool down to about 200° C. As a consequence of this gradual cooling down dioxins, which are detrimental to the environment, may be created.

OBJECTS AND SUMMARY OF THE INVENTION

It is now the objective of the invention to provide a novel method for combusting multifarious waste, whereby it is possible to combust the material in an economical manner in which the disadvantages mentioned above do not occur.

To that, end the invention provides a method for combusting multifarious waste material, characterized in that the waste to be combusted is subjected to a self maintaining pyrolysis in a long, horizontal chamber oven under oxygen depleted conditions, and is subsequently completely combusted under a supply of adequate air. The thereby pyrolysis occurs at temperatures of 1100°-1450° C., under which conditions an efficient pyrolytic decomposition occurs, whereby organic materials are decomposed into carbon and simple gases such as carbon monoxide and hydrogen, while inorganic materials are decomposed into simple oxides. To increase efficiency the hot pyrolysis gases emerging at the rear end of the chamber oven, may be combusted in a off gas conduit connected thereto under supply of adequate air or oxygen.

Usually, the pyrolysis is performed in an autoclave, which is heated externally. However, in the invention the pyrolysis is self maintaining, since the hot combusting pyrolysis gases themselves provide the heat for maintaining the pyrolysis in the remaining part of the oven.

In dependence of the waste material to be combusted, it may be necessary to add catalytically active substances to the hot flow of pyrolysis gas to be combusted in the off-gas conduit. If the off-gases are for example rich in nitrogen oxides, an active substance such as ammonia may be added.

The method according to the invention provides in a further purification of the off-gas, in that the flue gas emerging from the off-gas conduit is cooled rapidly and is purified by contacting with a gas washing liquid. Such a purification may occur for example in the manner described in the Dutch Patent Application No. 8902490 of the same applicant the subject matter of which is incorporated herein by reference. Efficiently the gas washing liquid may thereby selected from residual liquids with a high CZV (chemical oxygen consumption) value, which comprise complexing agents, compounds of heavy metals, sulphur and nitrogen compounds, and are derived amongst others from fixing baths and the like from the photographic, photochemical and galvanic industries.

With the method according to the invention, it is in principle possible to treat substantially any type of waste. For an efficient processing, in particular in connection with the self maintenance of the pyrolysis, the combustion value should be taken into account. In connection therewith, it is preferred, that the chamber oven is charged with waste, and sorted in such a way that the average energy content of the oven charge amounts to at least 7 MJ/kg.

The invention additionally provides a chamber oven to be used in the pyrolysis-combustion, characterised in that the oven is an oblong, horizontal, tubelike oven with refractory oven walls, which are resistent to high temperatures. The oven is provided at the front with a charging opening, closable with an oven door and at the rear an oven throat, emerging into a horizontal off-gas conduit, the diameter of which is small in comparison to that of the oven, whereby the long side walls of the oven are each one provided with an upper row of closable air inlet apertures at the upper side, divided over the wall length, and a lower row of closable air inlet apertures at the lower side, divided over the wall length, whereby a larger air inlet aperture is provided in each one of the side walls in the vicinity of the oven throat. All inlet apertures are also provided in the off-gas conduit.

By the provision of the rows of air inlet apertures in the side walls of the oven, an efficient oven control is possible, and the pyrolysis process can be adjusted and controlled in a desired manner.

Advantageously the processing may be such thereby that the off-gas conduit near the oven throat turns off square from the longitudinal direction of the oven, and an injection aperture is provided into the wall of the off-gas conduit at this turn-off, directed along the longitudinal axis of the turned off off-gas conduit. By means of a suitable spray device catalyzing liquids, gases and air may be injected throught this injection aperture into the off-gas conduit. In addition a pilot-burner and/or support burner may be mounted there, in order to be able to adjust the combustion of the off-gas in a desired manner.

According to a particularly advantageous embodiment, at least the upper wall of the oven has a concavely domed shape, in order to reflect emanated heat of the pyrolysis process in focus. In practice, it is customary, that the oven, once filled with the waste to be pyrolysed, is ignited from the rear side, that is near the oven throat. To that end care has been taken, that specifically in the rear section of the oven a properly combustible charge, for example paper, celluloid, etc. is present. The emanated heat, caused by this intense combustion, occurring under heat supply, reflects by way of the domed wall towards the inside of the oven, and heats the material present there. By adjusting the air inlets in the oven it may be arranged that hereby the complete oven is gradually heated to pyrolysis temperature, whereby the various air inlets during the pyrolysis are blocked, in order to maintain an oxygen depleted atmosphere. In order to achieve heating of the oven as efficiently as possible, the upper wall of the oven is preferably completely or partially covered with heat-isolating layer of for example clay at the exterior.

In addition, the oven may further be provided with a concrete cover plate, comprising a weakening for the eventuality of gas explosions. Such gas explosions might occur if for example, especially in the starting period of the oven, there is still too much air in the waste material positioned in the oven, whereby locally a sudden fierce combustion might occur.

For the chamber oven according to the invention, a closable vent hole is provided in the oven door, through which the waste to be treated will be charged. This vent hole is blocked during pyrolysis, but is opened during the subsequent combustion of the pyrolised material, in order to achieve an additional air draught therethrough.

Finally, the invention provides a universal waste combustion system, consisting of one or a number of pyrolysis combustion units, each one consisting of three chamber ovens as described above, a central flue gas chamber, with which the off-gas conduits of the chamber ovens are connected, and a gas washing reactor connected with the flue gas chamber, for primary flue gas purification, and a central gas washing column with a number of superimposed washing steps, the gas washing reactors of the pyrolysis combustion units being connected in combination with said central gas washing column.

For practical reasons each of the central flue chambers are thereby preferably provided with an emergency chimney. Such a system is efficiently adjusted to the fact, that there are factually three phases in each oven cycle, that is pyrolysis, ash combustion, and annealing and cooling down. Each one of these phases has a duration of one or a plurality of days. The efficiency of the unit is increased since, in the oven unit the first oven can be pyrolysed, while in the second oven, where pyrolisation has already taken place, ash combustion occurs, while the third oven is in its annealing phase. In this manner a substantially continuous operation will be possible for such a unit. By using a plurality, for example two, of such units, waste types of varying properties discharged may moreover be treated simultaneously. The off-gas from the flue gas chamber is subsequently purified in the central gas washing column in the manner as described in the earlier mentioned Dutch Patent Application No. 8902490.

BRIEF DESCRIPTION OF THE DRAWINGS

The invention will be further elucidated in the following with reference to the drawings.

In the drawings.

DETAILED DESCRIPTION OF THE PREFERRED EMBODIMENTS

Figure 1:
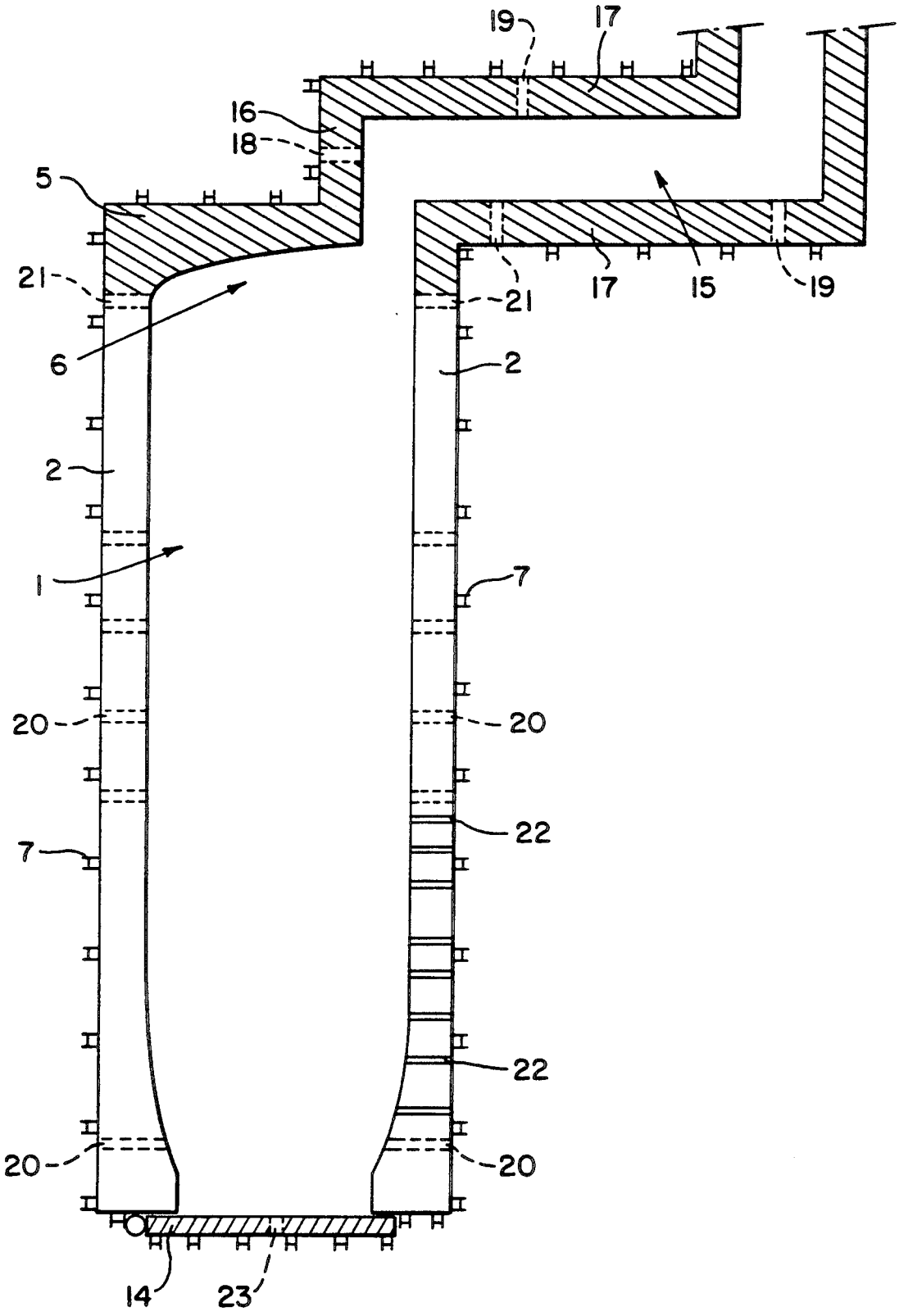
FIG. 1 shows an embodiment of a chamber oven for pyrolysis combustion according to the invention in horizontal cross-section.
Figure 2:
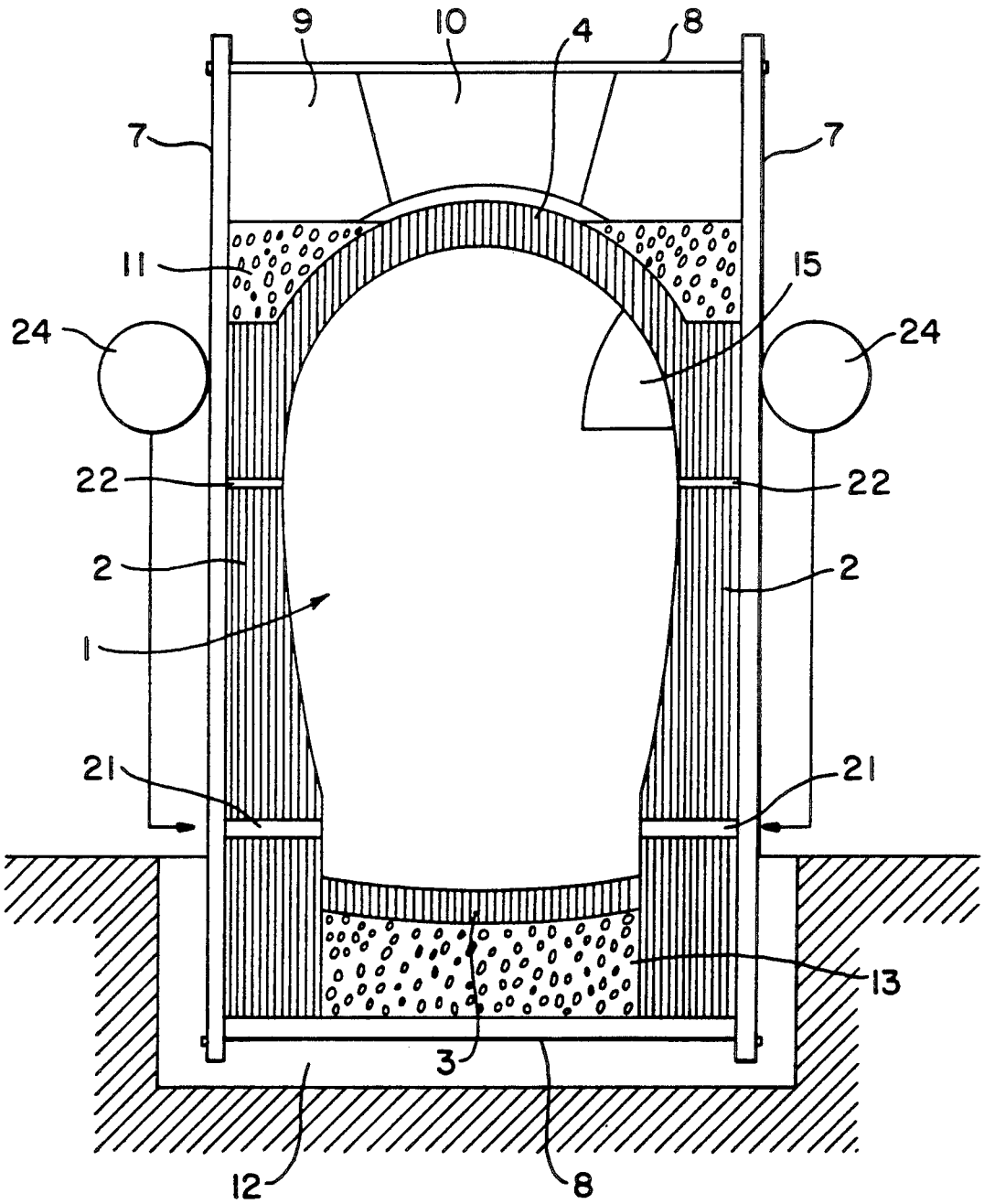
FIG. 2 a vertical cross-section of the oven of FIG. 1.

An embodiment of a chamber oven according to the invention is shown in FIGS. 1 and 2 in respectively horizontal and vertical cross-section. The horizontal oblong oven has a long oven chamber 1 having side walls 2, a bottom 3, a roof or upper wall 4 and a rear wall 5, which consist of high quality refractory material, resistent to high temperatures of over 1450° C. The oven roof 4 is made concavely domed while the side walls 2 at the inner side are also slightly concavely rounded out. This concave shape is intended to reflect heat emanated during the pyrolysis, toward the interior of the oven. The rear wall 5 and the oven throat 6 both exhibit a concave vaulting.

The side walls 2 of the oven are supported by steel beams 7, which are held together by tension bars 8. The oven roof 4 is made thinner than the oven side walls 2 and is covered with a layer of clay 11, leaving the center part uncovered. Above the clay and the oven roof is a concrete cover plate 9, having in the center a conical, removable weakening part 10. This so-called gas roof provides a protection for the eventuality of explosions.

The oven is fitted into a concrete bedding 12, and clay 13 is also applied between the bottom of the oven and the bedding. The layers of clay 11 and 13 both act as heat-isolators, in order to avoid heat of the oven from getting lost to the exterior of the oven.

At the front the oven has a charging opening, which is closed off by an oven door 14. The waste to be combusted is inserted into the oven through this charging opening.

At the rear of the oven near the throat 6 is a off-gas conduit 15. In embodiment shown, conduit 15 comprises two square turn-offs, the first one of which is located near the oven throat. At this section, the wall 16 of the conduit is square to the walls 17 of the conduit and forms as it were a type of "bottom" of the off-gas conduit 15. In this "bottom" 16, an injection opening 18 is present in the center, which serves for injecting catalysing liquids, air, and passage of the pilot flame and pilot burner (not shown). In the walls 16 and 17 of the conduit regularly distributed air inlet apertures 19 are present.

The oven itself is also provided with air inlet openings. Thus a row of air inlet openings 20, regularly distributed over the length of the oven, is present in each one of the long side walls 2 downwards near the bottom 3. A larger air inlet 21 is provided in each wall 2 adjacent to the oven throat 6. At the upper side of both side walls are rows of small air inlets 22, which act in particular for controlling the pyrolysis process. In the oven door 14 is also provided an air inlet 23, which acts also as an vent hole during the combustion after the pyrolysis and as injection opening for liquids to be combusted.

Now the functioning of this oven will be described.

Into the very large oven, for example with a length of 16 meters and a height of 4 meters, a charge of the waste to be combusted is introduced at the front. An oven charge may consist of a mixture of numerous materials, both combustible as well as non-combustible, in more or less finely divided form, as well as coarse, such as for example barrels, may further comprise liquids, slurries, shredder, soil, etc. A condition that there should be an average energy-content of at least 7 MJ/kg, in order to function in a profitable manner. On charging injection, care is taken that, at the rear side near the oven throat 6, sufficient properly combustible material is present, for example photographis film, paper, waste wood and the like.

Prior to igniting the oven, the off-gas conduit 15 is first heated. This is done by injecting combustible gas or liquid into conduit 15 by way of the injection opening 18 and to ignite this by means of a support burner or pilot burner. Owing to the many air inlets, a proper combustion occurs in the off-gas conduit, whereby after a short time a sufficiently high combustion temperature in the off-gas conduit is achieved. Subsequently the combustible material present at the rear side of the oven is ignited by means of a fuse or plug by way of one of the air inlets 19. As a consequence of the ample air supply by way of the air inlets 19 and the proper vent conditions in the heated off-gas conduit, a fast, complete combustion occurs here, the radiation of which is reflected against the domed oven walls, inwards and forwards in the oven. Hereby a gradual heating of further advanced and lower located material occurs. During this process the greater part of the air inlet apertures, as well as the vent hole in the oven door, are closed down, for example with plugs of glass-wool, so that little oxygen may enter into the oven proper. Hereby no normal combustion will occur in the oven. However, a pyrolysis, which is maintained by the combustion at the rear side of the oven does occur. Adjustment of the required heat and the speed of the pyrolysis process occurs by opening or closing the small air inlet apertures 22 at the upper side of the side walls.

In particular at the start of the process, in which some air is present in the charged waste, explosive reactions may occur, which in general however may be controlled. If explosive conditions would occur, the protection of the light gas roofing warrants in a customary manner, that the explosion may be diverted through the roof of the oven.

It is essential for the oven according to the invention that the off-gas conduit, through which the off-gases of the pyrolysis are passed and combusted, has a relatively small diameter in comparison with the diameter of the oven chamber. This relationship assures that the hot gas will stay for a long period of time in the oven and will contribute to the maintenance of the pyrolysis.

The considerable advantage of the pyrolysis treatment is that it provided a substantially complete decomposition of the waste to be processed, whereby organic compounds will be decomposed substantially into carbon, carbon monoxide and hydrogen, while inorganic materials are converted into oxides, which however in contrast to normal combustion will give rise to little slag formation. The small amount of slag which is formed can be removed easily by distributing a layer of sand covered with a thin layer of paper cuttings on the refractory bottom 3 of the oven at the start of the process. During the pyrolysis process, this paper layer will carbonize and the possible slag will deposit onto this carbon layer, and may be removed later with ease. The chamber oven according to the invention operates particularly efficiently. The large space in the chamber oven and the very low gas velocities in this area cause a long residence time of the gases, up to 30 sec. Thus, a high temperature of 1250° C. may be achieved and maintained in this chamber oven, and the influx of oxygen at numerous places through the inlets, causing a temporary excess of oxygen on leaving the chamber oven will cause a complete decomposition of larger organic molecules. A complete combustion is ultimately achieved in the narrow off-gas conduit, where, by means of the relatively wide injection opening 18, as well as the air inlets in the remainder of the off-gas conduit adequate oxygen for complete combustion is supplied. It is therefore important that in particular at the start of the off-gas conduit a very high temperature is maintained. In addition, as a consequence of the absence of turbulences, very little fly ash is formed in the pyrolising waste, a matter causing a considerable problem in the normal combustion by means of grid- and rotation ovens.

Once the pyrolysis reactions have been completed, carbon rich matter remains in the oven. Now, the next phase is started, the combustion, to which end the air inlets 21 at the lower side of the side walls of the oven are opened and air is gradually introduced. From this moment onwards liquids may also be injected for combustion by way of the injection opening 23 in the oven door. The air supply initially takes place by normal supply from the atmosphere; for an intensive after burning one may ultimately resort to supply of pressurized air by means of a source for pressurized air 24. Under these conditions, a complete combustion or roasting of the residual substances is achieved. During this latter phase the vent hole-injection opening 23 in the oven door 14 is also fully opened. Finally the oven is extinguished, whereafter the front side of the oven is opened, and after the ash has been moisted with water, it is removed together with possible slags. The total process requires three to eight days.

During the pyrolytic phase it may be necessary to add auxiliary materials, which act catalytically, by means of injection opening 18 during the combustion of the off-gases in the off-gas conduit. If, for example, an excess of nitrogen oxides is present in the off-gas, a solution of ammonia may for example be injected, whereby ammonium nitrate is formed, which decomposes into nitrogen, water and oxygen. If excessive CO is present solutions comprising chromium and copper ions for example, may be injected. These enter into the gas flow and will be converted into copper oxide and chromium oxide, which are efficient catalysts for the conversion of CO with abundantly present oxygen into carbon dioxide.

Otherwise the flue gas formed in the invention will in general not be discharged directly, but will be supplied to a suitable gas washing installation for further purification.

In an oven as described above, having dimensions of 16 meters long and 4 meters high, the oven volume is such, that it may accomodate a charge from 10 to 60 tons. This charge may consist of combustible=energy rich and incombustible=energy poor material. The total charge should provide so much energy on complete combustion that the required temperature of well above 1000° C. is achieved and maintained over a number of days. To that end, it is required that the oven charge have an average energy content of at least 7 MJ/kg. This latter value determines the ratio between combustible and incombustible waste material in the oven charge. In the following an example is given of an oven charge suitable thereby:

| | |
|---|---|
| Photographic film | 10 tons |
| Photographic paper | 20 tons |
| Other paper | 2 tons |
| Combustible fraction of refuge R.D.F. | |
| Plastic waste, cans | 2 tons |
| Waste wood | 1 ton |
| Barrels | 1 ton |
| Slurries | 6 tons |
| Shredder waste | 1 ton |
| Soil | 1 ton |
| Fats | 2 tons |
| Various | |
| | 46 tons |

The estimated average energy content of this charge is ±12 MJ/kg. During the combustion phase ±10 tons of aqueous liquid, for example residual liquid of developer, may be injected into the oven and combusted. If these 10 tons of waste are added to the total oven charge, the average energy content over the 56 tons of waste amounts to ±10 MJ/kg.

Figure 3:
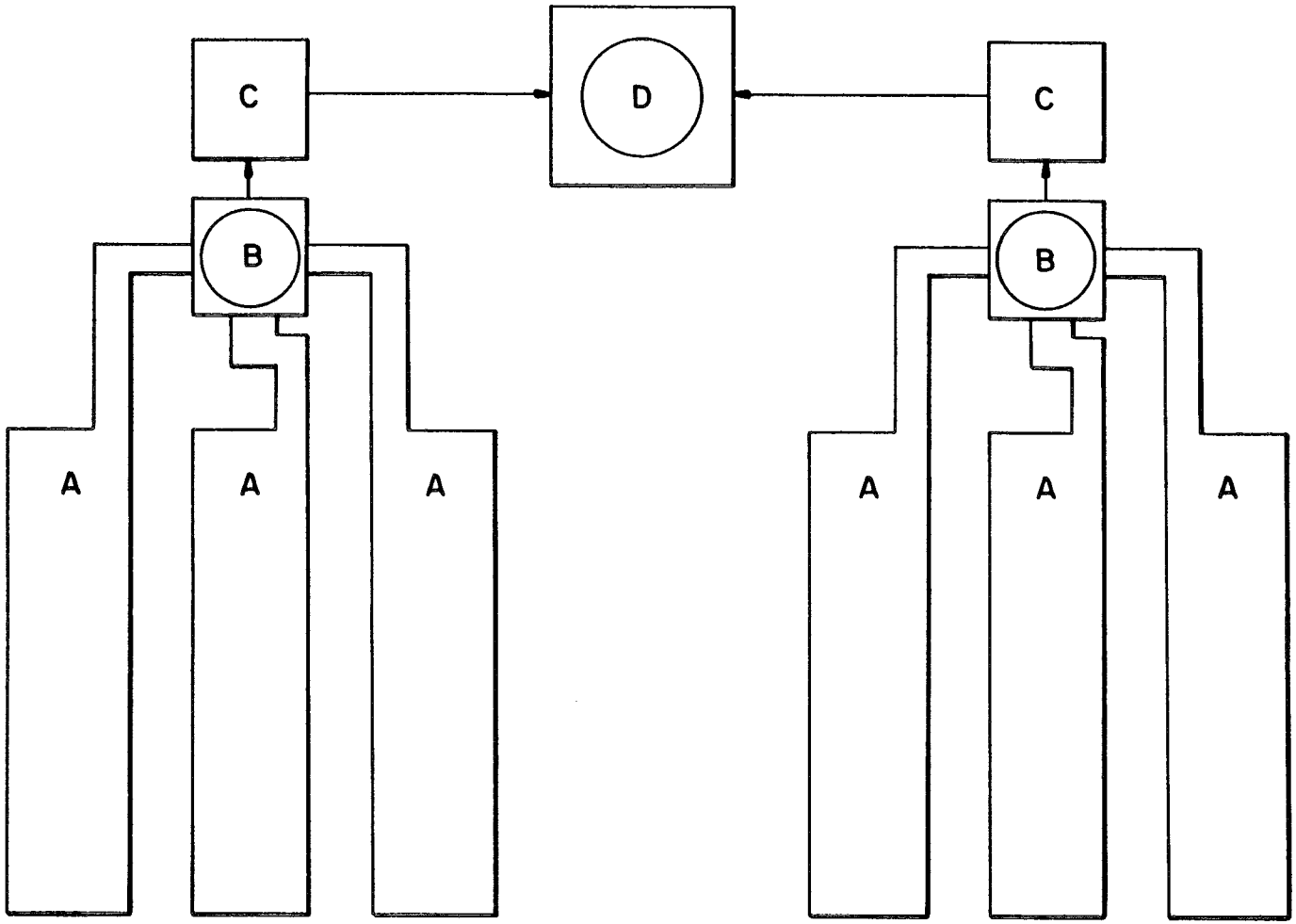
FIG. 3 a diagrammatical view of a universal waste combustion system according to the invention, whereby a number of such ovens are used, as well as a central gas washing system.

In FIG. 3 a universal waste combustion system according to the invention is shown diagrammatically, whereby a number of the above described ovens are applied to increase the efficiency of the unit. This system comprises two pyrolysis combustion units, each of which include three pyrolysis combustion ovens constructed according to the invention, designated with A. These ovens, each have a capacity of 50 tons, are in each unit connected with a common flue gas chamber B, provided with an emergency chimney. The flue-gas chamber B of each combustion unit is connected with a primary gas washing reactor C, and all primary gas washing reactors C are in turn connected with a common gas washing column D, in which a number of gas washing steps are positioned superimposed to each other. This system, consisting of the primary gas washing reactors C and the central gas washing column D, corresponds with the system described in the earlier mentioned Dutch Patent Application No. 8902490, aimed at the purification of flue gases. Just like in that case a residual liquid from the photographic industry or something similar is used as a gas washing liquid. The substantial advantage of the pyrolysis combustion units, consisting of three parallel positioned chamber ovens A, resides in that the action of the pyrolysis combustion according to the invention has three phases, to wit:

A) the pyrolysis phase, which takes 1 to 3 days,

B) the ash combustion phase, which equally takes 1 to 3 days, and

C) the annealing and cooling down phase, which takes 1 to 2 days.

By three parallel positioned ovens of such a pyrolysis unit, initially the first oven is charged and ignited. After three days the pyrolysis in this first oven is completed and the ash combustion phase begins, while in the second oven the pyrolysis is started. After 5 or 6 days the third oven is ignited for the pyrolysis, while the first oven is then in the cooling down phase and the ash combustion phase begins in the second oven. This cycle can be continued, so that waste may be processed without interruption.

The substantial advantage of such a way of processing is that, on the one hand, continued operation may be performed on a semi-continuous basis, while, on the other hand, also various types of waste may be processed in charges, so that the destination and further treatment or recycling of the ash may also be chosen. The treatment of the gases by means of the central gas washing column may proceed continuously.

In the above description the invention has been described with reference to more or less specific examples of a pyrolysis oven and a universal combustion system with two combustion units, each of which has three such pyrolysis ovens. However, it will be obvious that modifications are possible without deviating from the scope of the invention. Thus, for example, within the framework of the required conditions and demands the ovens may be modified with respect to shape and with respect to positioning, while also other provisions may be made. For a universal combustion system, more combustion units than the two described in the example may additional be used. Thus, for example, four of such systems may be centrally connected with a gas washing system. An efficient positioning is for example one in which four combustion units, each one having a primary gas washing reactor, are connected with a central washing tower with a number of gas washing stages.

I claim:

1. A method for combusting multifarious waste materials, comprising the steps of:

(A) inserting a discrete quantity of waste materials into an elongated chamber of an oven; then (B) subjecting said quantity of waste materials to a self-maintaining pyrolysis under oxygen depleted conditions; then (C) increasing the flow of oxygen into said chamber to combust said materials by introducing adequate oxygen into said chamber to provide for complete combustion of said materials.

2. A method according to claim 1, wherein said step (B) is performed at temperatures of 1100°-1450° C.

3. A method according to claim 1, wherein said step (B) comprises the step of forming hot pyrolysis gases and said step (C) comprises the step of combusting said hot pyrolysis gases in a rear end portion of said chamber and in an off-gas conduit connected to said rear end portion.

4. A method according to claim 3, further comprising the step of adding a catalytically active substance to said hot pyrolysis gases during said step (B).

5. A method according to claim 4, wherein said step of adding a catalytically active substance comprises the step of adding at least one of ammonia and solutions comprising chromium and copper ions.

6. A method according to claim 3, further comprising the steps of rapidly cooling and purifying with a washing liquid flue gases emerging from said off-gas conduit.

7. A method according to claim 6, wherein said step of purifying with a washing liquid comprises the step of purifying said flue gases with residual liquids which have a high CZV-value and which include at least one of complexing agents, compounds of heavy metals, and sulphur and nitrogen compounds, and which are derived from fixing baths from at least one of the photographic, photochemical, and galvanic industries.

8. A method according to claim 1, wherein said step (C) comprises the step of opening air inlets which open into said chamber.

9. A method for combusting multifarious waste materials, comprising the steps of:

(A) inserting waste materials having an energy of an average of at least 7 MJ/kg into an elongated chamber; then (B) subjecting said quantity of waste materials to a self-maintaining pyrolysis under oxygen depleted conditions; and then (C) combusting said materials by introducing adequate oxygen into said chamber to provide for complete combustion of said materials.

10. A chamber oven for combusting multifarious waste materials, said chamber oven comprising:

(A) an off-gas conduit;

(B) a refractory oven having a pair of elongated side walls which define an oblong, horizontal, tube-like oven chamber therebetween which has a diameter which is large when compared to that of said off-gas conduit, said oven chamber having a front end having a charging opening formed therein and a rear end comprising an oven throat which opens into said off-gas conduit; and (C) an oven door which is adapted to close said charging opening; wherein an upper row of closable air inlet apertures is provided in an upper side of each of said side walls, said apertures of each of said upper rows being evenly distributed over the length of the respective side wall, a lower row of closable air inlet apertures is provided in a lower side of each of said side walls, said apertures of each of said lower rows being evenly distributed over the length of the respective side wall, a relatively large air inlet aperture is provided in each of said side walls in the vicinity of said oven throat, and air inlet apertures are provided in said off-gas conduit.

11. A chamber oven according to claim 10, wherein a portion of said off-gas conduit located near said oven throat projects at a right angle from a longitudinal direction of said oven, and wherein an injection aperture is provided in a wall of said portion of said off-gas conduit and extends along a longitudinal direction of said off-gas conduit.

12. A chamber oven according to claim 10, further comprising an upper wall which has a concavely domed shape which reflects the heat radiation of a pyrolysis process back into said oven in focus.

13. A chamber oven according to claim 12, further comprising a bottom surface of said oven which is concavely domed.

14. A chamber oven according to claim 12, wherein an exterior surface of said upper wall is at least partially covered with a heat-isolating layer.

15. A chamber oven according to claim 14, further comprising a concrete plate which covers said oven and which has a weakened portion designed to rupture in the case of an explosion in said oven chamber.

16. A chamber oven according to claim 11, further comprising bedding, a bottom surface of said oven, and a heat isolating layer disposed between said bedding and said bottom surface.

17. A chamber oven according to claim 10, wherein an opening is provided in said oven door.

18. A universal waste combustion system comprising:

(A) a plurality of pyrolysis combustion units, each of which comprises an off-gas conduit, a refractory oven having a pair of elongated side walls which define an oblong, horizontal, tube-like oven chamber therebetween which has a diameter which is large when compared to that of said off-gas conduit, said oven chamber having a front end having a charging opening formed therein and a rear end comprising an oven throat which opens into said off-gas conduit, and an oven door which is adapted to close said charging opening, wherein an upper row of closable air inlet apertures is provided in an upper side of each of said side walls, said apertures of each of said upper rows being evenly distributed over the length of the respective side wall, a lower row of closable air inlet apertures is provided in a lower side of each of said side walls, said apertures of each of said lower rows being evenly distributed over the length of the respective side wall, a relatively large air inlet aperture is provided in each of said side walls in the vicinity of said oven throat, and air inlet apertures are provided in said off-gas conduit;

(B) a plurality of central flue-gas chambers, each of which is connected to the off-gas conduit of a respective one of said combustion units;

(C) a plurality of gas washing reactors, each of which is connected to a respective one of said flue-gas chambers and which performs primary flue gas purification; and (D) a central gas washing column which is connected to each of said gas washing reactors and which has a number of superimposed washing steps.

19. A universal waste combustion system according to claim 18, wherein each of said central flue-gas chambers has an emergency chimney.

* * * * *